United States Patent [19]

Parker et al.

[11] 4,359,132

[45] Nov. 16, 1982

[54] HIGH PERFORMANCE SPEAKER DIAPHRAGM

[75] Inventors: Roy B. Parker, Monmouth; Daniel R. Levesque, Lewiston, both of Me.

[73] Assignee: Albany International Corp., Albany, N.Y.

[21] Appl. No.: 263,767

[22] Filed: May 14, 1981

[51] Int. Cl.[3] ..... D04H 1/58; H04R 7/12

[52] U.S. Cl. ..... 181/169; 179/115.5 R; 179/115.5 ES; 264/119; 264/122; 264/126; 428/65; 428/288

[58] Field of Search ..... 179/115.5 R, 115.5 ES; 181/169; 264/119, 122, 126; 428/288, 280, 65

[56] References Cited

U.S. PATENT DOCUMENTS

| | | | |
|---|---|---|---|
| 1,393,515 | 10/1921 | Egerton . | |
| 1,543,394 | 6/1925 | Parsons | 428/280 |
| 4,195,112 | 3/1980 | Sheard et al. | 428/288 |
| 4,258,093 | 3/1981 | Benedyk | 264/126 |
| 4,291,781 | 9/1981 | Niguchi | 181/169 |

FOREIGN PATENT DOCUMENTS

| | | | |
|---|---|---|---|
| 52-65421 | 5/1977 | Japan | 181/169 |
| 55-7751 | 2/1980 | Japan | 181/169 |
| 55-53995 | 4/1980 | Japan | 181/169 |

*Primary Examiner*—James C. Cannon

*Attorney, Agent, or Firm*—Kane, Dalsimer, Kane, Sullivan and Kurucz

[57] ABSTRACT

The disclosure is of a high performance speaker diaphragm which comprises needled and interlocked textile staple fibers of a first, relatively heat-resistant fiber and a second, heat-softenable fiber. The fibers are molded together to soften the second fiber whereby it interlocks with the first fiber.

6 Claims, 4 Drawing Figures

FIG.1
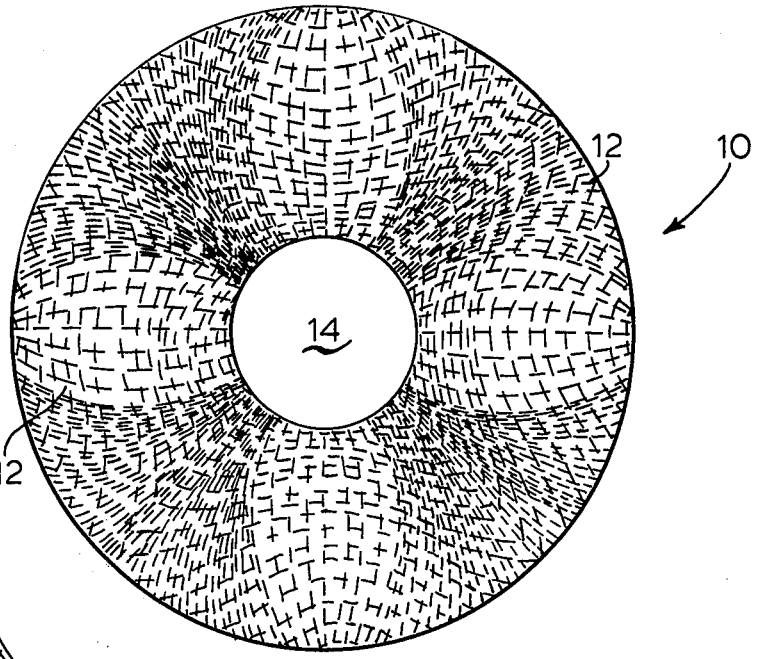
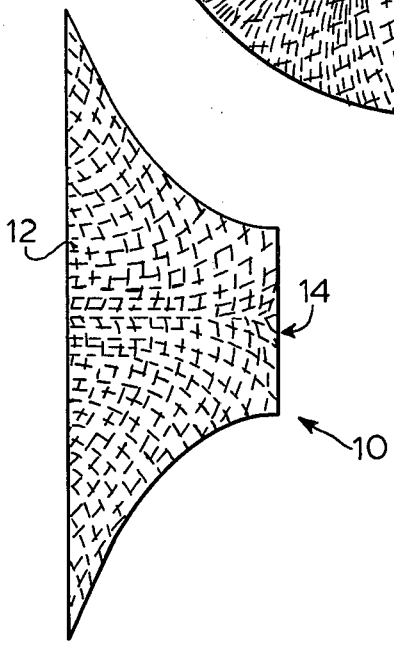
FIG. 2
FIG. 3
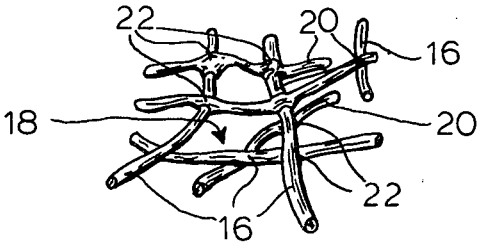

HIGH PERFORMANCE SPEAKER DIAPHRAGM

BACKGROUND OF THE INVENTION

1. Field of the Invention

The invention relates to loudspeakers and more particularly relates to loudspeaker diaphragms and methods of their manufacture.

2. BRIEF DESCRIPTION OF THE PRIOR ART

The literature is replete with descriptions of loudspeaker diaphragm constructions and the method of their manufacture. Representative of such descriptions are those found in the U.S. Pat. Nos. 1,393,515; 3,937,905; 4,076,098 and 4,190,746. In spite of the highly developed state of the art, there remains a need for more efficient diaphragm constructions and methods of manufacture.

The diaphragms of the present invention are particularly advantageous in that they exhibit a superior efficiency of input to output ratio. The method of the invention is advantageous in that it produces speaker diaphragms of consistently reproducible, uniform quality and character. The method of the invention is also highly economical, reducing costs and labor in the manufacturing process.

SUMMARY OF THE INVENTION

The invention comprises a speaker diaphragm, which comprises;

- a plurality of first textile staple fibers which are stable at a given degree of temperature which is above temperature ranges to which the diaphragm will be exposed under conditions of normal use;
- a plurality of second, heat-softened and re-hardened textile staple fibers which soften at the given degree of temperature but are stable at temperatures within said temperature ranges;
- said first and second fibers being entangled together, the entanglement being of the character associated with needled, mixed fibers;
- the first and second fibers being interlocked at cross-over points;
- said entangled and interlocked fibers together being shaped in the form of a speaker diaphragm.

The invention also comprises the method of fabricating the speaker diaphragms of the invention.

The term "staple fiber" is used in its conventional sense to mean fibers having an average length of 1½ inches.

BRIEF DESCRIPTION OF THE DRAWINGS

FIG. 1 is an end view of an embodiment diaphragm of the invention.

FIG. 2 is a side view of the diaphragm shown in FIG. 1.

FIG. 3 is an enlarged view of a portion of the diaphragm shown in FIGS. 1 and 2.

DETAILED DESCRIPTION OF THE PREFERRED EMBODIMENTS OF THE INVENTION

Figure 4:
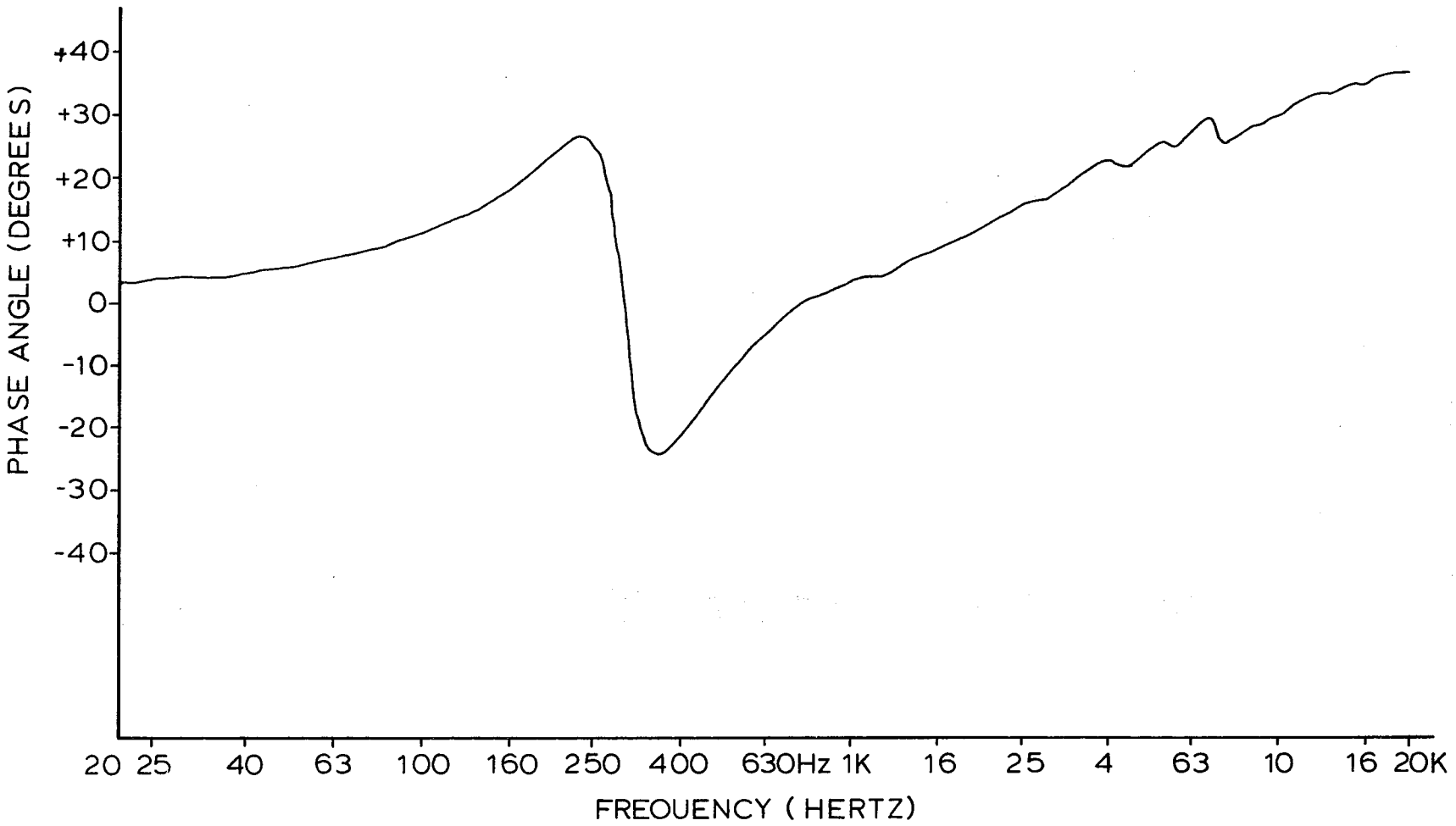
FIG. 4 is a graph showing the phase angle data for a speaker of the invention.

FIG. 1 of the accompanying drawings is an end view of a loudspeaker diaphragm 10 shaped as a cone. The diaphragm 10 is open at both ends for open communication through passage 14.

FIG. 2 is a side view showing in particular the preferred conical shape of the diaphragm 10. The cone wall 12 is formed from non-woven, textile staple fibers 16 and 20 as shown in FIG. 3, an enlarged portion of the cone wall 12. The fibers 16 are textile, staple fibers which are relatively heat-resistant, i.e., stable at a given degree of temperature substantially above temperature ranges under which the diaphragm 10 will be operated. Preferably, the fibers 16 are stable at temperatures of from about 350° F. to 450° F. Representative of such fibers are those made from polyaramids such as poly(m-phenylene isophthalamide), poly(p-phenylene terephthalamide) and the like.

The fibers 20 are textile staple fibers of synthetic, thermoplastic, polymeric resins characterized in part by their softening at temperatures above the temperature range under which the diaphragm 10 will normally operate, but below the degree of temperature which would degrade the fibers 16. Representative of fibers 20 are fibers of polypropylene, polyethylene, polyvinyl chloride and the like. Preferred as the fiber 20 are fibers of polypropylene.

The fibers 16, 20 are separated from each other by void spaces 18, which are essential to the performance of the diaphragm 10. The void spaces may be measured in terms of the density of the cone walls 12, which advantageously are within the range of from about 0.20 gms/cc to about 0.78 gms/cc. The fibers 16, 20 are entangled and touch each other at cross-over points 22. As may be seen in FIG. 3, the fibers 16, 20 are also interlocked at the cross-over points 22. Interlocking occurs during the method of the invention (which will be described more fully hereinafter) when the fibers 20 heat soften and under pressure conform to the shape of touching fibers 16 at the cross-over points 22. When the fibers 20 re-harden, they are interlocked with the fibers 16 at the cross-over points 22. The interlocked fibers 16, 20 provide structural integrity to the diaphragm 10, permitting it to retain any desired shape. It will be appreciated that retention of a given form for the diaphragms of the invention is dependent upon the proportion of interlocked cross-over points 22. In general, the required interlocks are obtained when the proportion of fibers 20 in the mixture of fibers 16, 20 is within the range of from about 30 to about 95 percent by weight of the mixture, preferably 50 to 80 percent.

The diaphragm 10 may be made in accordance with the method of the invention. In the first step, one provides a homogeneous blend of the loose staple fibers 16, 20 as described above in the desired proportions. The techniques and apparatus for providing such fiber blends are well-known in the art. Preferably the blended fibers are provided in the form of a non-woven batt having a weight within the range of from about 80 to about 305 gms/m$^2$. The denier of the fibers 16, 20 is not critical and may be, for example, within the range of from 1.5 to 20.0.

The blend of fibers 16, 20 preferably in batt form, is needled to entangle the fibers 16, 20 and to consolidate the mass of mixed fibers so that there is obtained a textile fabric having some structural integrity and cohesiveness. The technique of needling is well-known and details need not be recited here; see for example the description in U.S. Pat. No. 2,910,763. In general, needling may be carried out in a single pass of the mass of blended fibers through a needle loom carrying 38 gauge barbed needles. The needling frame may be fitted with either high or low density needle boards, a 34 density board being illustrative. Needling is preferably carried out to produce a needled fabric having a weight within the range of from about 100 to about 335 gms/m$^2$.

In the next step of the method of the invention, the needled fabric is cut roughly to the desired shape, clamped into a retaining ridged frame, placed into a heating oven, inserted into a cold mold and molded to the desired shape and size. Although the diaphragm 10 shown is cone shaped (a preferred shape), diaphragms of the invention may be of any conventional shape including flat, domed, etc. The oven is heated to a temperature sufficient to soften the fibers 20, but less than that which would degrade the fibers 16. After the fibers 20 are softened and the fabric and frame are rapidly transferred to the mold, molding pressure will force the heat-softened fibers 20 to conform to and interlock with the heat-stable fibers 16 at the cross-over points 22. After a sufficient time for interlocking to occur and cooling to take place, the mold is opened. The finished diaphragm 10 may then be removed from the mold trimmed to dimension and is ready for assembly with a driving coil of a loudspeaker assembly.

The finished diaphragms of the invention may be used without further treatment under many circumstances. When their use may include formation of standing waves in the body of the diaphragm, they may be dampened with coatings of known lossy materials such as synthetic elastomeric resins. Representative of such resins are films of polyvinyl acetate which may be applied from emulsions thereof. The coatings are over portions of the fibers 16, 20.

The following example sets forth the best mode contemplated by the inventors of making and using the invention but is not to be considered as limiting.

EXAMPLE

Two 85 g/m$^2$ batts of a 50% polypropylene 1.8 denier 64 mm fiber, 50% Kevlar [poly(p-phenylene terephthalamide)] (1.5 denier 50 mm) are combined using a 38 gauge multibarb needle in a 34 density needleboard. 632 penetrations per square inch are applied to the fabric which is a 159 g/m$^2$ needlefelt of 2.4 mm thickness and an air permeability of 210 CFM per square foot of fabric at ½ inch water pressure drop.

This fabric is placed onto a ridged iron framework larger in area than the pressing area of the mold and the framework and fabric are heated in a infrared oven set at 370° F. for 95 seconds. The fabric/frame is removed and placed into a press within 5 seconds. The press contains a male/female mold of the desired configuration necessary to produce a speaker core. The press is closed with a pressure of 9800 pounds force applied to 162 square centimeter area. The mold originally at 75° F. remains closed under pressure for 120 seconds and is then opened. The ridged speaker cone is removed, die cut to a circular shape, center cut to provide the open area 14 and coated with the lossy material to the appropriate uniformity on the back side.

Upon testing, the diaphragm is found to have the following characteristics:

| | |
|---|---|
| Density | 0.263 gms/cc |
| Mass | 1.204 grams |
| Thickness | 0.31 mm |

Phase angle data for the cone produced is determined by mounting a transducer in the cone and testing at various frequencies. The data is shown in FIG. 4.

What is claimed:

1. A speaker diaphragm, which comprises:

a plurality of first textile staple fibers which are stable at a given degree of temperature which is above temperature ranges to which the diaphragm will be exposed under conditions of normal use;

a plurality of second, heat-softened and re-hardened textile staple fibers which soften at the given degree of temperature but are stable at temperatures within said temperature ranges;

said first and second fibers being entangled together to form cross-over points in a non-woven fabric, the entanglement being of the character associated with needled, mixed fibers wherein said first and second fibers are separated from each other by void spaces, except where they touch at cross-over points;

the first and second fibers being interlocked at cross-over points;

said entangled and interlocked fibers having been molded under heating conditions in the form of a speaker diaphragm.

2. The diaphragm of claim 1 wherein the first fibers are fibers of poly(p-phenylene terephthalamide).

3. The diaphragm of claim 2 wherein the second fibers are fibers of polypropylene.

4. The diaphragm of claim 1 wherein said form is conical.

5. A method of making speaker diaphragms, which comprises;

providing a homogeneous blend of a first textile staple fiber, which are stable at a given degree of temperature which is above temperature ranges to which the diaphragm will be exposed under conditions of normal use, and a second textile staple fiber which will soften at the given degree of temperature but is stable at temperatures within said ranges;

needling the blend to obtain a non-woven fabric; and molding the fabric into a diaphragm shape under sufficient heat and pressure to soften the second fibers and interlock them with the first fibers at points where the first fibers cross-over the second fibers said first fibers being separated from said second fibers at points other than said cross-over points, by void spaces.

6. The method of claim 5 wherein the first fibers are fibers of poly(p-phenylene terephthalamide) and the second fibers are fibers of polypropylene.

* * * * *